United States Patent [19]

Mardak

[11] Patent Number: 4,709,895

[45] Date of Patent: Dec. 1, 1987

[54] PORTABLE VIEWING STAND

[75] Inventor: Keith R. Mardak, Elm Grove, Wis.

[73] Assignee: Hal Leonard Publishing Corporation, Milwaukee, Wis.

[21] Appl. No.: 9,574

[22] Filed: Jan. 30, 1987

Related U.S. Application Data

[63] Continuation-in-part of Ser. No. 829,769, Feb. 14, 1986, abandoned.

[51] Int. Cl.[4] ..... A47B 97/04

[52] U.S. Cl. ..... 248/460; 248/459

[58] Field of Search ..... 248/460, 459, 451, 455, 248/462, 450, 463, 174, 445; 211/42, 73; 281/45, 33; 40/12 D, 152.1

[56] References Cited

U.S. PATENT DOCUMENTS

| | | | |
|---|---|---|---|
| 205,156 | 6/1878 | Turner . | |
| 284,228 | 9/1883 | Pickering . | |
| 337,544 | 3/1896 | Yaggy | 248/460 |
| 987,019 | 3/1911 | Shapro | 281/33 |
| 1,099,775 | 6/1914 | Smith | 281/33 |
| 1,614,977 | 1/1927 | Ausmus | 281/33 |
| 1,845,952 | 2/1932 | Wright | 281/33 |
| 2,035,021 | 3/1936 | Pyle et al. . | |
| 2,091,260 | 8/1937 | Farkas et al. | 281/33 UX |
| 2,698,493 | 1/1955 | Nichols | 248/459 X |
| 2,784,929 | 3/1957 | Diening . | |
| 2,982,568 | 5/1961 | Wolfe | 281/33 |
| 3,381,928 | 5/1968 | White | 248/460 X |
| 3,410,516 | 11/1968 | Criswell . | |
| 3,690,620 | 9/1972 | Matson | 248/459 X |
| 3,794,284 | 2/1974 | Guenther . | |
| 4,105,182 | 8/1978 | Jacobson . | |
| 4,274,616 | 6/1981 | Radtke . | |
| 4,544,123 | 10/1985 | Peacock | 248/460 |

*Primary Examiner*—J. Franklin Foss

*Attorney, Agent, or Firm*—Merchant, Gould, Smith, Edell, Welter & Schmidt

[57] ABSTRACT

A portable collapsible apparatus for supporting material such as sheet music to be viewed by an individual without the need for the viewing individual to support the article by hand. The apparatus includes a plurality of pivotally connected rigid members which are pivotable about a plurality of parallel spaced apart axes. The material extends from a forward edge to a free edge with a transverse stop provided at the forward edge. The rigid members are sized such that the free edge is pivotable to a position opposing the stop with a support surface projecting away from the stop at an inclined angle to support the article to be viewed.

5 Claims, 12 Drawing Figures

FIG. 1
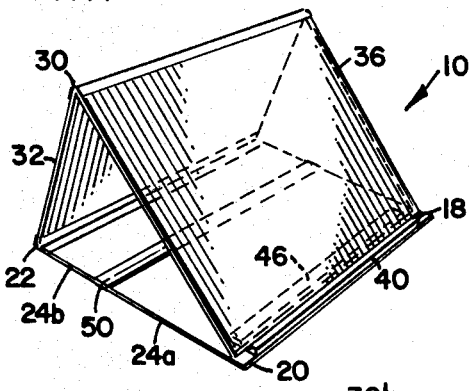
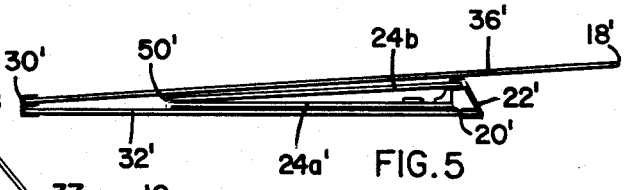
FIG. 5
FIG. 2
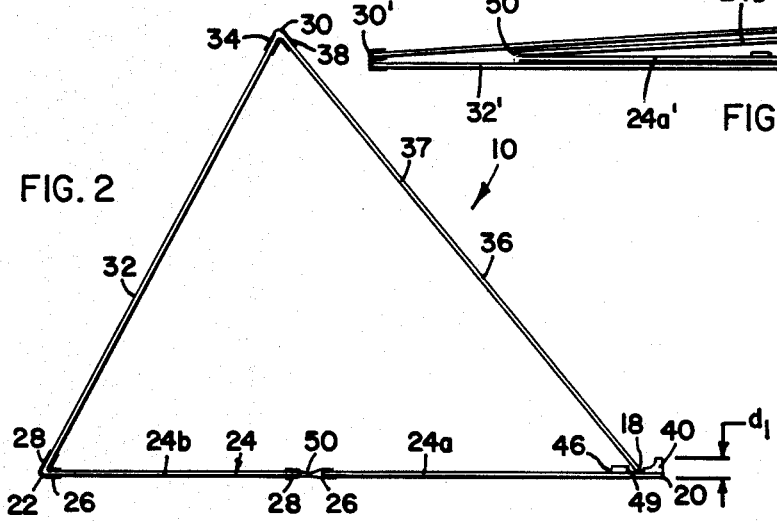
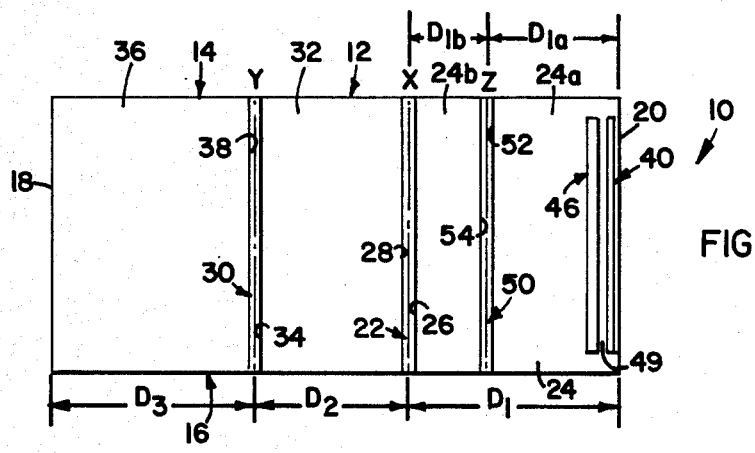
FIG. 3
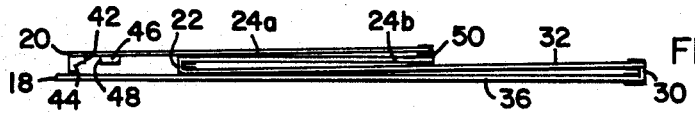
FIG. 4

PORTABLE VIEWING STAND

This is a continuation-in-part of application Ser. No. 829,769 filed Feb. 14, 1986, now abandoned.

BACKGROUND OF THE INVENTION

I. Field of the Invention

This invention pertains to apparatus for supporting an article to be read by an individual without the need for the individual to support the article by hand. More particularly, this invention pertains to such an apparatus which is portable and collapsible for transport and storage yet readily assembled on any flat horizontal surface such as a table top.

II. Description of the Prior Art

In the music industry, apparatus to support sheets of music have long been used. Typically, such apparatus includes a floor mounted stand which supports an inclined surface having a lower upwardly projecting ledge. Sheet music or the like is disposed on the inclined surface with the upwardly projecting ledge retaining the sheet music in position. Commonly, the height of the inclined surface can be raised or lowered to accommodate a musician who is either standing or sitting.

Prior art music stands, as described above, have proven extremely useful but they are not without inconveniences. For example, such stands are stored in their upright position and require a substantial amount of room for storage. Also, during storage many such music stands are jammed together where they may rock about and damage one another. Particularly, the protruding retaining ledge is subject to damaging impact.

In addition to storage and handling problems, such prior art music stands are not readily transportable. While such stands are portable in the sense that they can be moved from place to place within a room, they are not easily moved from location to location over any significant distance without substantial inconvenience.

Finally, such stands are not sufficiently flexible to address the various needs of musicians. This is particularly true for youngsters learning to play a musical instrument. The environment and location where such students may study varies widely and often cannot accommodate prior art music stands. It would be desirable to provide such students with a sheet music support which is sufficiently flexible such that it could be placed on a desk top or on the upper surface of a bed while the student is practicing a musical instrument. Also, it would be desirable for such a stand to be readily transportable from place to place and easily storable while protecting essential elements of the stand. Unfortunately, the art has not developed such a stand.

OBJECTS AND SUMMARY OF THE PRESENT INVENTION

It is an object of the present invention to provide an apparatus for supporting an article to be viewed by an individual without the need for the viewing individual to support the article by hand.

A yet further object of the present invention is to provide a collapsible apparatus for supporting an article to be viewed which may be placed on a generally flat horizontal surface such as a table top.

A yet further object of the present invention is to provide a portable apparatus with means for supporting an article to be viewed which is collapsible onto itself in a manner to provide for ready storage of the apparatus and protect article supporting members from impact and damage.

According to a preferred embodiment of the present invention, a portable, collapsible apparatus is provided for supporting an article to be viewed by an individual without the need for the viewing individual to support the article by hand. The apparatus includes a planar base member which is sized to lie on a generally flat horizontal surface. The base member has a forward edge and a parallel spaced apart rear edge. A first rigid support member having a first edge disposed parallel to the rear edge is provided pivotally secured to the rear edge for free rotation about a first axis. A second rigid planar support is provided and sized to support an article to be viewed. A first edge of the second rigid planar support member is pivotally secured to the second edge of the first rigid planar support member and freely pivotable about a second axis parallel to the first axis. A stop is secured to the base member adjacent the forward edge. The dimensions of the base member, first support member and second support member are provided such that when the members are pivoted about the first and second axis, a free end of the second support member will abut the stop with the base member, first support member and second support member defining a rigid structure having an inclined support surface and an article supporting ledge. The apparatus is collapsible onto itself with the article supporting ledge protected from impact.

BRIEF DESCRIPTION OF THE DRAWINGS

FIG. 1 is a perspective view of a portable viewing support according to the present invention shown in an assembled position;

FIG. 2 is a side view of the apparatus of the present invention taken in elevation;

FIG. 3 is a plan view of the apparatus of the present invention in an unfolded position;

FIG. 4 is a side view taken in elevation of the apparatus of the present invention in a fully collapsed position ready for storage;

FIG. 5 is a side view taken in elevation of the apparatus in an alternative collapsed position.

DESCRIPTION OF THE PREFERRED EMBODIMENT

Figure 6:
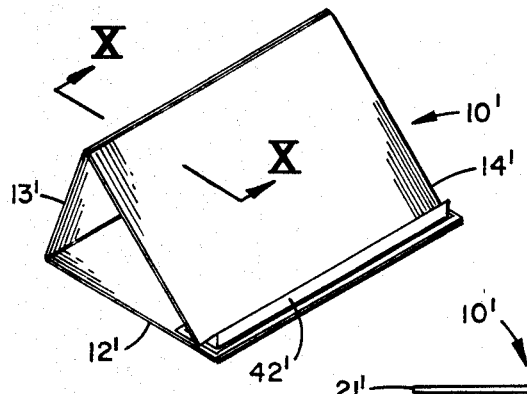
FIG. 6 is a perspective view of a portable viewing support according to a second preferred embodiment of the present invention.

Referring to FIG. 1, a portable viewing support according to the present invention is shown generally at 10 in a fully assembled position. The same apparatus is shown in FIG. 3 in an unfolded planar position. In FIG. 4, the same apparatus is shown in a fully collapsed position. As shown in the drawings, the apparatus is formed from a generally rectangular sheet of thin rigid material 12 having a first longitudinal side edge 14 which is spaced apart in parallel relation from a second longitudinal side edge 16. First and second side edges 14 and 16 are joined by parallel edges including a free edge 18 and a forward edge 20 which are each perpendicular to side edges 14, 16.

A first fold line 22 is formed in the planar material and extends parallel to the forward edge 20 between the forward edge 20 and free edge 18. The portion of material disposed between fold line 22 and forward edge 20 is freely pivotable about fold line 22 relative to material disposed between fold line 22 and free edge 18. Fold line 22 which acts as a first pivot axis X—X can be formed in any of a plurality of means but, preferably, is formed by severing the material at fold line 22 to define a base member 24 extending between forward edge 20 and a parallel rear edge 26 which is spaced from forward edge 20 by a first predetermined distance $D_1$. An opposing edge 28 of material at the sever along fold line 22 is joined to edge 26 in any suitable manner such as by applying a tape joint on both sides of the material. In this manner, fold line 22 is a flexible joint with a flexible portion extending between edges 26 and 28 having a distance between edges 26 and 28 being greater than a height of a stop member 40.

A second fold line 30 is formed in the material and disposed parallel to the first fold line 22 between the first fold line 22 and free edge 18. Fold line 30 is preferably formed identical as fold line 22 by providing a sever through the material at line 30 such that line 30 divides the material between line 22 and edge 18 into a first support member 32 extending between a first edge 28 and a second edge 34 with second edge 34 parallel to edge 28 and spaced therefrom by a second predetermined distance $D_2$. Similarly, sever 30 defines a second support member 36 of rigid material between free edge 18 and a first edge 38. First edge 38 of second support 36 and second edge 34 of first support 32 are pivotally hinged together by a tape hinge joint. Consequently, second support member 36 freely pivots relative to first support member 32 about a second pivot axis Y—Y parallel to first pivot axis X—X. As shown in FIG. 3, free edge 18 is spaced from fold line 30 by a predetermined third dimension $D_3$.

A transverse stop element 40 is provided adjacent forward edge 20 and is shown best in FIG. 2 as having a raised stop surface 42 generally perpendicular to base member 24 and opposing the rear edge 26. Stop element 40 extends the length of edge 20 and also includes an arcuate concave surface 44 facing upwardly away from base member 24. At forward edge 20, stop element 40 has maximum height of $d_1$ above the upper surface of edge 20. The height $d_1$ is preferably controlled to approximately equal to twice the thickness of the rigid material.

A transverse brace member 46 is provided extending parallel to stop element 40 and secured to base member 24. Brace member 46 includes a bracing surface 48 opposing stop surface 42 and closely spaced therefrom. Bracing surface 48 and stop surface 42 cooperate to define a transverse slot 49 sized to receive free end 18. The amount by which $D_{1a}$ is greater than $D_{1b}$ will be equal to at least the thickness of stop member 40 measured in a direction parallel to side edges 14 and 16 and preferably not greater than a combined thickness of stop member 40, brace member 46 and slot 49.

A third fold line 50 is provided formed through the material of base member 24 and parallel to axis X—X. Fold line 50 separates base member 24 into a first portion **24*a* extending between forward edge 20 and line 50 and a second portion 24*b* extending between line 50 and rear edge 26. Preferably, line 50 is positioned such that the distance $D_{1a}$ between edge 20 and line 50 is slightly greater than the distance $D_{1b}$ between line 50 and edge 26. Line 50 is preferably formed by severing the material of base member 24 to present opposing edges 52 and 54** which are hinged together by a flexible tape hinge to define a third pivot axis Z—Z parallel to axes X—X and Y—Y.

With the apparatus assembled, it will be appreciated that first support member 32 may be pivoted in a clockwise direction (as viewed in FIG. 2) about axis X—X and second support member 36 may likewise be pivoted in a clockwise direction (when viewed in FIG. 2) about axis Y—Y to the position as shown in FIGS. 1 and 2 with free edge 18 received within the transverse slot defined between opposing surfaces 42 and 48 of transverse members 40 and 46. With base member 24 received on a flat rigid horizontal surface, the base member portions **46*a* and 46*b* are restrained from pivotable movement about axes Z—Z. Preferably, distance $D_1$ is approximately equal to distance $D_3$ with distance $D_2$ being smaller. Accordingly, the apparatus forms a rigid triangular cross section support stand with an inclined surface 37 projecting upwardly and away from support surface 44 with surfaces 37 and 44 supporting articles to be viewed by an individual. In the preferred embodiment, the support stand 10 will support sheet music or the like where the lower edge of the sheet music may be received abutting surface 44 and retained in flat viewable position by the rigid surface of support member 36. In the event the support 10 is used to support a more massive article such as a book, brace member 46 restrains free edge 18 from sliding against the weight of the book causing collapse of apparatus 10**.

With the novel structure of the present invention and the flexible hinges so described, the apparatus 10 may be collapsed into a storage position as shown in FIG. 4.

As shown in FIG. 4, to store the apparatus, first base member portion **24*a* is pivoted in a counterclockwise direction (as viewed in the Figures) about axis Z—Z. Since axis Z—Z is located closer to axis X—X than it is to forward edge 20, stop element 40 will be displaced away from axis X—X. As mentioned, pivot axis X—X is a flexible axis having a flexible portion of dimension slightly greater than the distance $d_1$. First support member 32 may be pivoted about axis Y—Y in a counterclockwise direction while simultaneously pivoting folded base member 24 in a clockwise direction about axis X—X until second support 36 comes to rest against first support member 32 and base portion 24*b* rests against an opposite surface of first support member 32 as shown in FIG. 4. Since the height $d_1$ of stop member 40 is approximate to twice the thickness of the rigid material, the apparatus lies flat in the collapsed position of FIG. 4. Alternatively, the base portion 24*a* can be folded counterclockwise to about axis Z—Z and the folded portion folded counterclockwise about axis X—X. Second support may be folded clockwise about axis Y—Y with the apparatus assuming the position of FIG. 5. In this position, stop member 40 is nested within flexible hinge 22 and protected from impact. However, this is not as desirable as the fold of FIG. 4** where the apparatus is flat and more suitably stored.

Figure 9:
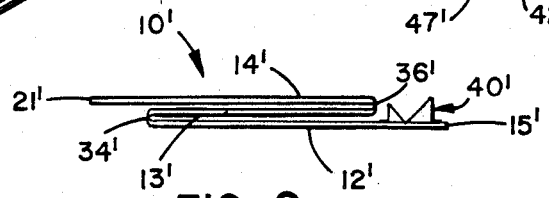
FIG. 9 is a side view taken in elevation of the apparatus of FIG. 6 in a fully collapsed position.
Figure 7:
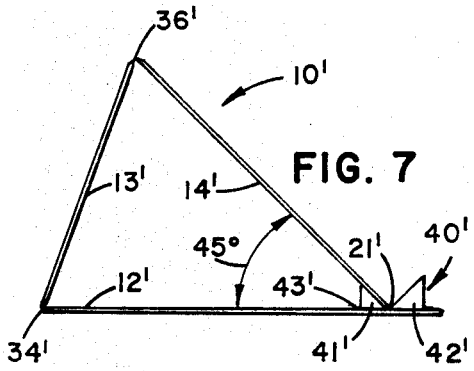
FIG. 7 is a side view of the apparatus of FIG. 1.
Figure 10:
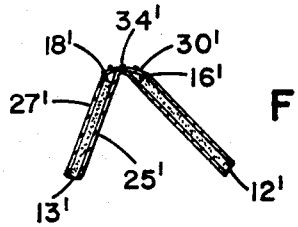
FIG. 10 is a view taken along lines X—X of FIG. 6.
Figure 11:
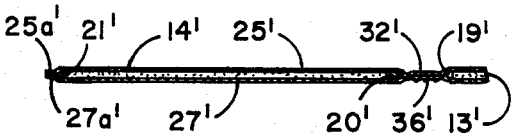
FIG. 11 is a view taken along lines XI—XI of FIG. 8.

FIGS. 6–12 show an alternative preferred embodiment of the present invention. This apparatus is shown in unfolded planar position in FIG. 8. The detail of the construction of the apparatus is shown in FIGS. 10 and 11.

Referring to FIGS. 6–12, the apparatus is generally shown at 10'. The apparatus includes three rigid rectangular panels formed of rigid cardboard, particle board or the like. The panels include a first panel 12', a second panel 13' and a third panel 14'.

Figure 8:
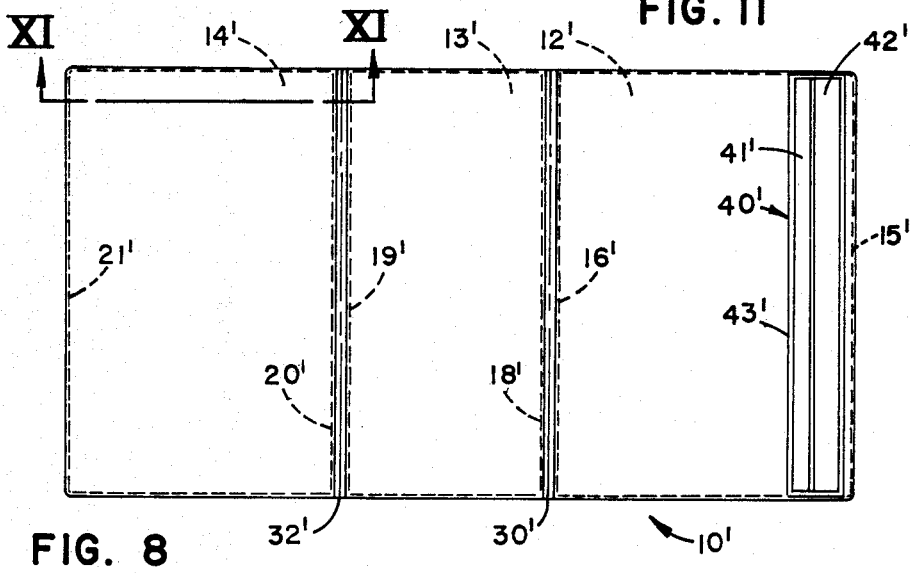
FIG. 8 is a plan view of the apparatus of FIG. 6 shown in an unfolded position.

First rigid panel 12' includes a forward edge 15' and a rear edge 16'. The second rigid panel 13' has first and second spaced apart edges 18' and 19', respectively. As shown in FIG. 8, panel 13' is disposed with its first edge 18' spaced from and opposing rear edge 16'.

The apparatus also includes third panel 14' which has first and second spaced apart edges 20' and 21', respectively. Third panel 14' is disposed adjacent second panel 13' with first edge 20' spaced from an opposing second edge 19'.

A first sheet 25' of flexible plastic material is disposed covering first sides of each of the first, second and third panels, 12', 13' and 14'. A second sheet 27' of flexible plastic material is disposed covering second sides of panels 12'–14'. The first and second sheets, 25', 27' are sized to extend beyond the peripheral edges of the panels with peripheral edges of the sheets opposing one another. In FIG. 11, a peripheral edge 25a' of sheet 25' is shown opposing a peripheral edge 27a' of sheet of 27'.

The first and second sheets 25', 27' are sized to extend beyond the peripheral edges of the panels which peripheral edges of the sheets opposing one another. A portion of the first sheet 25' opposes a portion of the second sheet 27' between opposing edges 16', 18' of first and second panels 12', 13' to define a first hinge area 30'. Similarly, a portion of the first sheet 25' opposes a portion of the second sheet 27' between opposing edges 19', 20' of the second and third panels, 13' 14' to define a second hinge area 32'.

Opposing peripheral edges 25a', 27a' are sealed to define an enclosed volume between sheets 25', 27' with the panels, 12'–14' disposed within the enclosed volume. Similarly, opposing portions of sheets 25', 27' in the first hinge area 30' are sealed to form a first flexible hinge seal 34'. Opposing sheet portions in the second hinge area 32' are sealed to form a second flexible hinge seal 36' between second and third sheets 13', 14'.

The first and second hinge seals 34', 36' divide the enclosed volume into first, second and third pockets in which are contained the first, second and third panels, 12'–14', respectively. The hinge seals 36', 34' accommodate pivotable movement of adjacent panels about pivot axis which are generally parallel to opposing edges of the panels.

Figure 12:
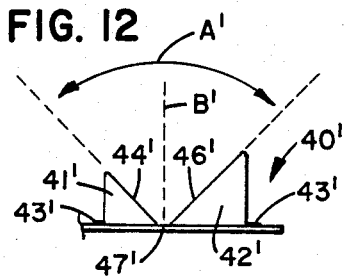
FIG. 12 is an enlarged view of a stop of the apparatus of FIG. 6.

A stop 40' is conected to the outer surface of sheet 25' at forward edge 15'. The stop 40' is formed of vacuum molded plastic of other formed rigid material having a mounting fange 43' sealed to sheet 25' with stop 40' running parallel to edge 15'. Stop 40' has a first triangular prism portion 41' and an opposing second triangular prism portion 42' (shown best in FIG. 12). Each of prism portions 41' and 42' have support or retaining surfaces 44', 46, respectively (shown best in FIG. 12). Surface 44' project upwardly away from edge 15'. Surface 46' projects upwardly and toward edge 15'. The retaining surfaces 44', 46' are disposed to define an included angle A' of about 90° with a bisecting line B' (shown in phantom lines in FIG. 12) of angle A' being disposed generally normal to first panel 12'. As best shown in FIG. 12, retaining surfaces 44', 46' are spaced apart at the point of juncture between the retaining surfaces and panel 12'. The spacing 47' is sized to be sufficient to receive the second edge 21' of third panel 14'.

With an apparatus as constructed according to the above description and FIGS. 6–12, the adjacent panels may be pivoted about hinge seals 36', 34' until the apparatus assumes the shape of a triangular prism with edge, 21' abutting, or received within stop 40'. The panels 12', 13', 14' are sized for the third panel to define a lesser included angle C' of about 45° with the first panel 12' when the panels are disposed assuming the triangular prism shape. So sized, third panel 14' rests flat against retaining surface 44' and defines a 90° angle with retaining surface 46'. With the apparatus as described, a book or similar article may rest securely on panel 14' with the bottom portion, of the book being securely supported by retaining surface 46'. This construction permits the use of a very heavy article or book and the full height and length of retaining surface 44' ensures that the panel 14' will remain in its inclined position without the weight of the book or other impact forcing out of alignment.

When the apparatus is no longer needed, it may be collapsed into the form shown in FIG. 9. As shown, panel 13' is selected to have a dimension between edges 18' and 19' being less than a distance between edge 16' and stop 40. Accordingly, the apparatus can be folding with panels 13' and 14' disposed above panel 12' and opposing stop 40. This provides an ultimately narrow collapsed structure which facilitates storage and transportion. The apparatus of FIGS. 6 through 12 has many advantages. The use of flexible plastic sheets 25', 27' with rigid panels 12', 13', 14' provides a sturdy support 10' which is readily manufactured and has a durable easily cleaned surface. The novel structure of stop 40' holds a book or other article at a convenient 45° angle and supports the bottom of the article. The spacing of surfaces 44', 46' ensures that edge 21' is snugly captured within the stop 40' between surfaces 44', 46'. So captured, the edge 21' is retained from being knocked out of stop 40' upon impact by a book or similar article. Also, the height and length of surface 44' provides for retention of heavy articles. Finally, the angle of surface 44' together with the sizing of panels 12', 13', 14' cooperate to ensure the panel 14' will securely rest flat on surface 44' and retained at a convenient angle.

As a result of the novel construction of the present invention, portable table top sheet music support stands can be readily assembled and disassembled in a matter of seconds and easily transported and stored without damage to the music support element. While it is preferred that such an apparatus would be intended for supporting sheets of music, it will be appreciated that the apparatus of the present invention can be used for supporting a variety of articles to be viewed such as cookbooks or for use as a portable podium to hold documents to be used by a speaker.

From the foregoing detailed description of the present invention, it has been shown how the objects of the invention have been obtained in a preferred manner. However, modifications and equivalents of the disclosed concepts such as those which readily occur to those skilled in the art are intended to be included in the scope of this invention. Thus, the scope of this invention is intended to be limited only the by the scope of the claims as are or may hereafter be appended hereto.

What is claimed is:

1. A portable collapsible apparatus for supporting an article to be viewed by an individual without the need for the viewing individual to support the article by hand, said apparatus comprising;

a first rigid panel (12') having a rear edge (16') and a forward edge (15');

a second rigid panel (13') having first and second spaced apart edges (18', 19'), said, second panel (13') disposed adjacent said first panel (12') with said first edge (18') of said second panel generally parallel to and spaced from said rear edge (16');

a third rigid panel (14'), having first and second spaced apart edges (20', 21'), said third panel (14') disposed adjacent said second panel (13') with said first edge (20') of said third panel generally parallel to and spaced from said second edge (19') of said second panel;

a first sheet (25') of flexible material disposed covering first sides of said first, second and third panels;

a second sheet (27') of flexible material disposed covering second sides of said first, second and third panels;

said first and second sheets (25', 27') each sized to extend beyond peripheral edges of said panels with peripheral edges (25a', 27a') of said sheets opposing one another;

a portion of said first sheet (25') opposing a portion of said second sheet (27') between opposing edges (16', 18') of said first and second panels (12', 13') to define a first hinge area (30');

a portion of said first sheet (25') opposing a portion of said second sheet (27') between opposing edges (19', 20') of said second and third panels (13', 14') to define a second hinge area (32');

a seal formed joining opposing peripheral edges (25a', 27a') of said sheets (25', 27') to define an enclosed volume between said sheets with said panels (12',13', 14') disposed within said enclosed volume;

a first flexible hinge seal (34') formed joining opposing sheet portions in said first hinge area (30');

a second flexible hinge seal (36') formed joining opposing sheet portions in said second hinge area (32');

said first and second hinge seals dividing said enclosed volume into first, second and third pockets containing said first, second and third panels, respectively, said hinge seals accommodating pivotal movement of adjacent panels about pivot axes generally parallel to opposing edges of said panels;

a stop (40') secured to one of said sheets and protruding above said first panel (12') and adjacent said forward edge (15') of said first panel, said stop disposed to abut said second edge (21') of said third panel (14') when said panels are pivoted about said hinge areas to generally assume a shape of a triangular prism with said third panel projecting upwardly and away from said stop, and said stop (40') including a first retaining surface (44') extending upwardly from said first panel (12') and away from said forward edge (15'), said stop further including a second retaining surface (46') extending upwardly from said first panel (12') and toward said forward edge (15').

2. An apparatus acording to claim 1 wherein said second panel (13') has a dimension extending between said first and second edges (18', 19') of said second panel, said dimension sized to be less than a distance between said stop (40') and said rear edge (16') of said first panel (12').

3. An apparatus according to claim 10 wherein said first and second retaining surfaces (44', 46') are joined to said first panel (12') with said surfaces spaced apart at a point of juncture to said first panel.

4. An apparatus according to claim 3 wherein said first and second retaining surfaces (44', 46') define an included angle (A) of about 90° a bisecting line (B) of said angle (A) being disposed generally normal to said first panel (12').

5. An apparatus according to claim 1 wherein said panels are sized for said third panel (14') to define a lesser included angle (C') of about 45° with said first panel (12') when said panels (12', 13', 14') are disposed assuming said triangular prism shape.

* * * * *